US009072338B1

(12) United States Patent
Kostecky

(10) Patent No.: US 9,072,338 B1
(45) Date of Patent: Jul. 7, 2015

(54) INTERCHANGEABLE FOOTWEAR ASSEMBLY

(76) Inventor: James Kostecky, Wormleysburg, PA (US)

( * ) Notice: Subject to any disclaimer, the term of this patent is extended or adjusted under 35 U.S.C. 154(b) by 364 days.

(21) Appl. No.: 13/517,768

(22) Filed: Jun. 14, 2012

Related U.S. Application Data

(60) Provisional application No. 61/520,978, filed on Jun. 20, 2011.

(51) Int. Cl.
*A43B 7/26* (2006.01)
*A43B 3/12* (2006.01)
*A43B 3/10* (2006.01)

(52) U.S. Cl.
CPC ... *A43B 7/26* (2013.01); *A43B 3/10* (2013.01); *A43B 3/103* (2013.01); *A43B 3/122* (2013.01)

(58) Field of Classification Search
CPC ..... A43B 3/12; A43B 3/128; A43B 3/122; A43B 3/126
USPC ..... 36/94, 104, 11.5, 7.5, 101, 50.1
See application file for complete search history.

(56) References Cited

U.S. PATENT DOCUMENTS

| | | | | |
|---|---|---|---|---|
| 1,554,883 | A * | 9/1925 | Sahlin | 602/30 |
| 2,928,191 | A * | 3/1960 | Meltzer | 36/94 |
| 3,748,757 | A * | 7/1973 | Silver | 36/11.5 |
| 3,978,596 | A * | 9/1976 | Brown et al. | 36/11.5 |
| 6,904,706 | B2 | 6/2005 | Jones et al. | |
| 7,681,331 | B2 | 3/2010 | Bathum | |
| 2007/0245597 | A1* | 10/2007 | Krutilek et al. | 36/101 |
| 2008/0110054 | A1* | 5/2008 | Lewis | 36/101 |
| 2010/0212184 | A1* | 8/2010 | Rudd et al. | 36/11.5 |
| 2011/0214311 | A1* | 9/2011 | Stonisch | 36/101 |

* cited by examiner

*Primary Examiner* — Jila M Mohandesi
*Assistant Examiner* — Katharine Gracz
(74) *Attorney, Agent, or Firm* — Harpman & Harpman

(57) ABSTRACT

A convertible interchangeable post assembly for sandals/flip flop footwear. The post assembly allows for a variety of decorative toe post to be selectively available for a sandal toe post flip flop configuration by using an interchangeable toe post assembly that is removably inserted into a fixed receptacle within the sole of the footwear.

6 Claims, 5 Drawing Sheets

20C
17
20B
20
11
16
23
26
24A
19
24B
16A 22
21
18
15A
15

INTERCHANGEABLE FOOTWEAR ASSEMBLY

BACKGROUND OF THE INVENTION

1. Technical Field

This invention relates to footwear, specifically sandals and so called flip flops that typically have a simple sole element with a toe engagement post and extending strap configurations that hold the footwear on the user's foot.

2. Description of Prior Art

Prior art footwear of this type have relied on a number of different post and strap constructions characterized by sandal thongs, slip on like designs. Examples of footwear with adjustment and replaceable straps and post assemblies can be seen in U.S. Pat. Nos. 6,904,706 and 7,681,331.

In U.S. Pat. No. 6,904,706 a sandal thong having a reversible tongue, vamp or strap utilizing a ball socket configuration allowing portions of the strap to be adjustable.

U.S. Pat. No. 7,681,331 is directed to a sandal having an adjustable center post assembly wherein a post has one or more flexible straps that can be adjustably secured to transversely extending sandal straps.

SUMMARY OF THE INVENTION

An interchangeable decorative toe post system for sandals/flip flop type footwear having a post receiving receptacle within the sole to selectively secure a variety of decoratively different interchangeable toe post having a common universal locking insertion mount.

DETAILED DESCRIPTION OF THE INVENTION

Figure 1:
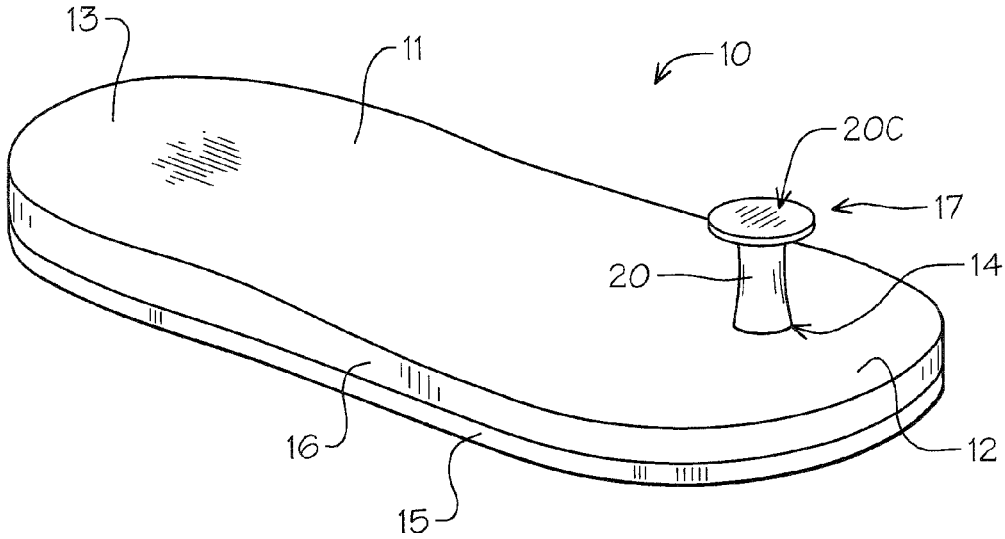
FIG. 1 is a perspective view of the assembled footwear.

Referring to FIG. 1 of the drawings, a footwear sandal/flip flop 10 of the invention can be seen having a contoured sole 11 with a toe end portion 12 and oppositely disposed heel end portion 13. The toe end portion 12 is of an increased transverse dimension with a toe post mounting area at 14 thereon. The sole 11, in this example, is of a multi-layer fabrication having a bottom sole layer 15 of an overall equal dimensional thickness, best seen in FIGS. 4 and 9 of the drawings. A top sole layer 16 of a registerably exterior dimension that of said bottom layer 15 has a tapered increasing thickness extending from the toe end portion 12 to a maximum thickness at the heel end portion 13.

An interlocking removable toe post assembly 17 of the invention can be seen in FIGS. 2, 4, 5 and 6 of the drawings having a post receiving mount 18 and interlocking insert 19 and an elongated transversely annular curved exterior resilient post body 20.

Figure 4:
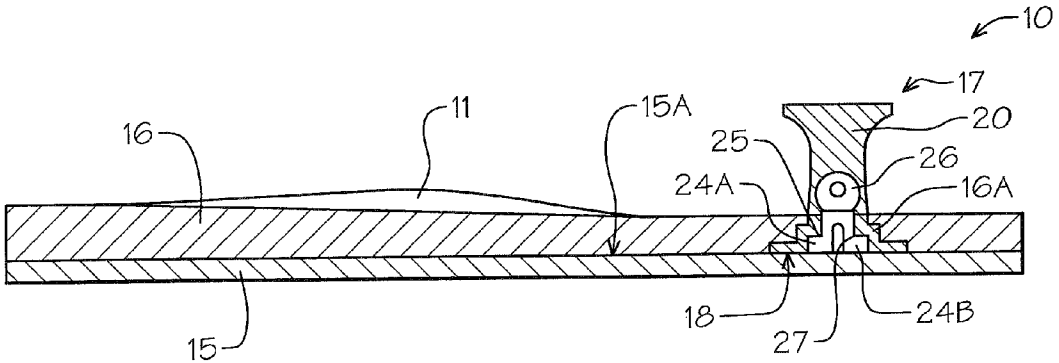
FIG. 4 is a section on lines 4-4 of FIG. 3.
Figure 5:
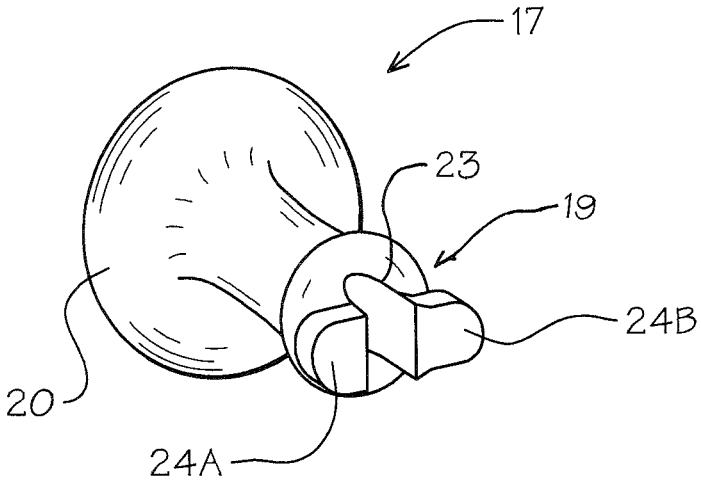
FIG. 5 is a perspective view of the toe post assembly of the invention.
Figure 6:
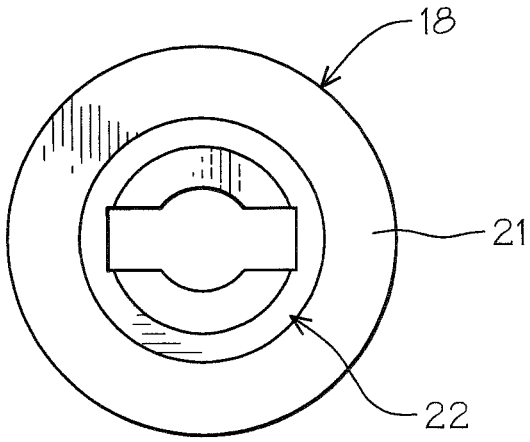
FIG. 6 is a top plan view of the receiving mount for the toe post.
Figure 7:
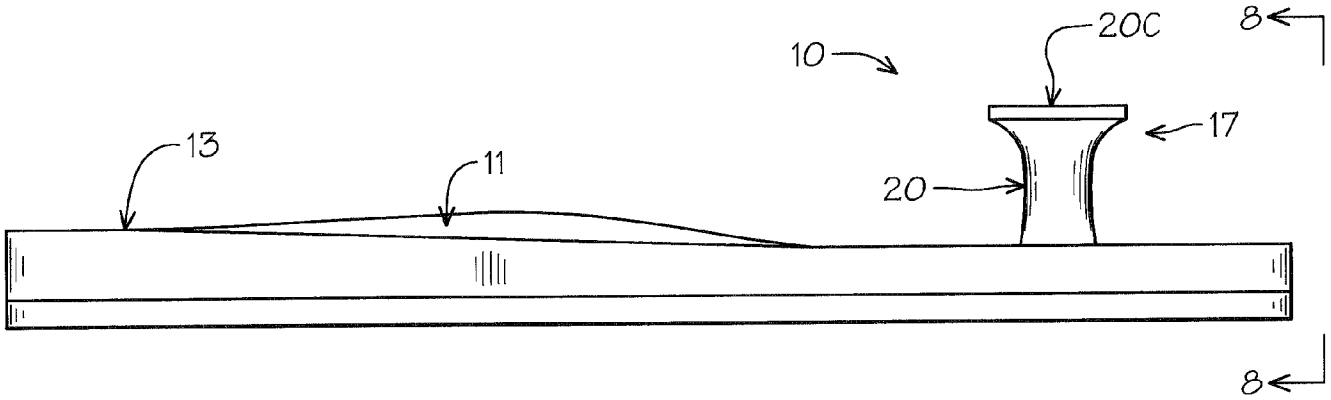
FIG. 7 is a side elevational view of the completed footwear.
Figure 9:
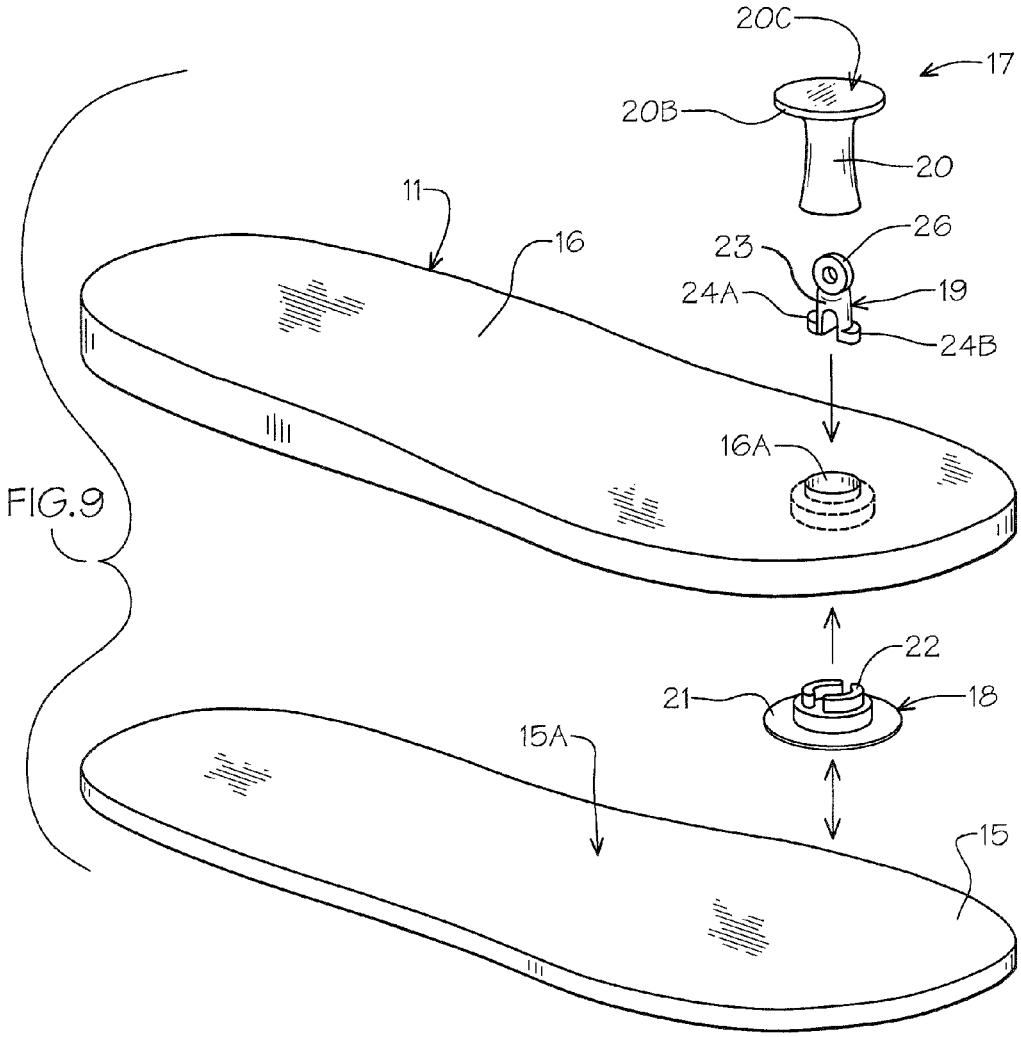
FIG. 9 is an exploded perspective view of the toe post and footwear assembly sequence.

The receiver mount 18, best seen in FIGS. 4, 6 and 9 of the drawings has an annular disk shape base 21 with upstanding apertured arcuate step lugs 22 spaced oppositely extending therefrom. The lug 22 defines a key hole shaped retainment opening extending therethrough. The receiver mount 18 is positioned on an upper surface 15A of the bottom sole layer 15 before assembly in the hereinbefore defined toe post receiving area 14. The sole layer 16 has an opening at 16A therein for registering alignment over the positioned lug 22 and is accordingly bonded to the layer 15 forming the assembled sole configuration as best seen in FIG. 4 of the drawings.

The interlocking insert 19 has a central cylindrical bifurcated body member 23 defining independent oppositely disposed locking tabs 24A and 24B with tapered upper surfaces 25 thereon extending therefrom. An apertured annular embodiment disk portion 26 extends integrally from the cylindrical body member 23 best seen in FIGS. 4 and 9 of the drawings and provides a retainment engagement surface for the exterior resilient post body 20 as will be described in greater detail hereinafter.

Figure 2:
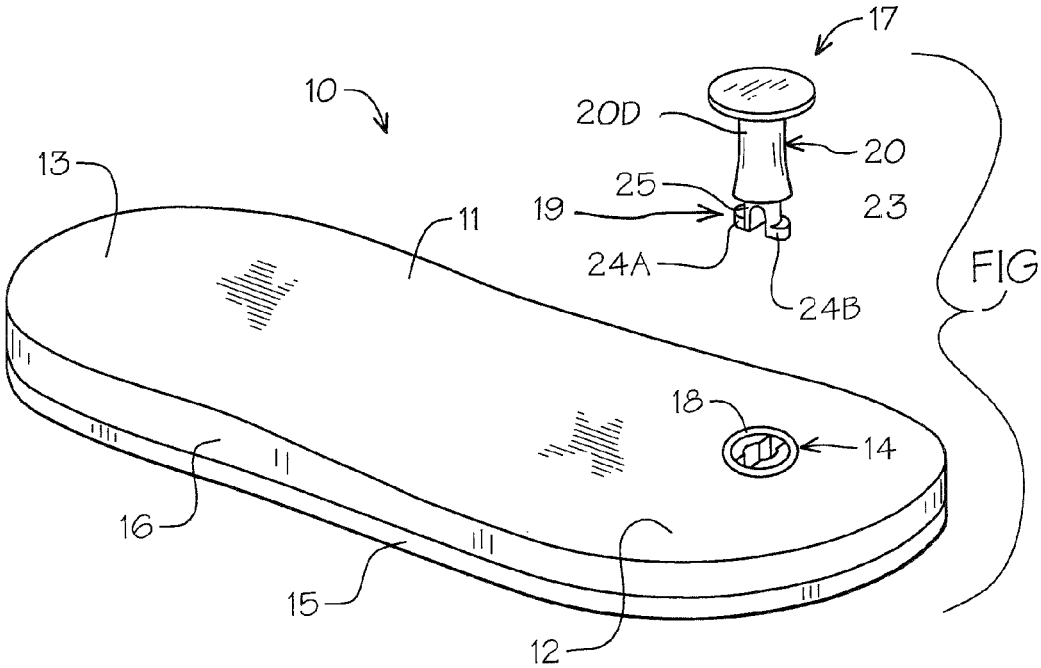
FIG. 2 is an exploded perspective view of the footwear prior to assembly.
Figure 3:
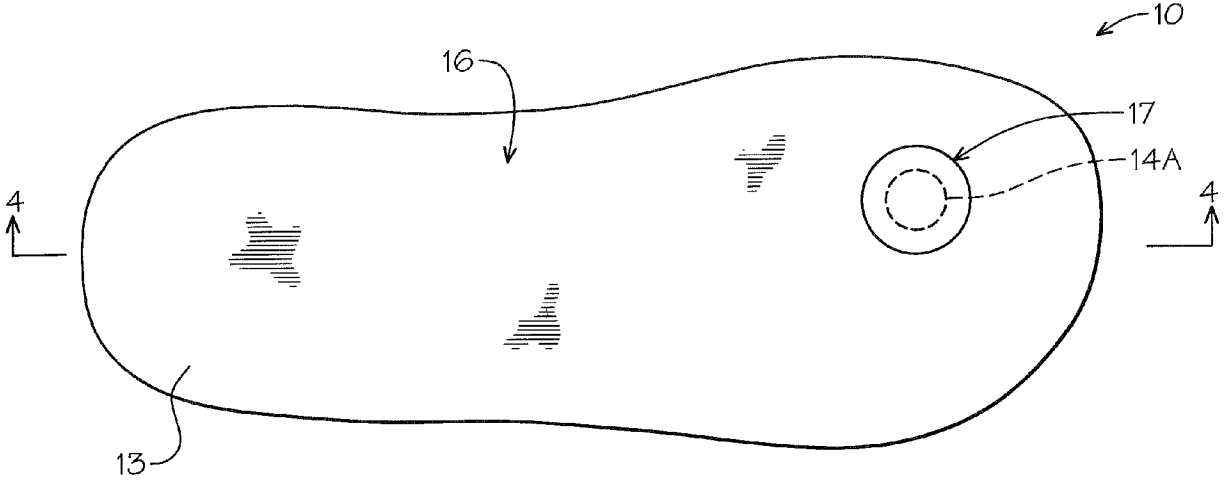
FIG. 3 is a top plan view of an assembled footwear.

The flexible soft post body 20 is in practice over molded around the hereinbefore described embodiment retainment disk portion 26 of the interlocking insert 19 which affords selective retainment thereof within the receiver lock mount 18 securing same to the assembled sole 11 as best seen in FIGS. 1 and 2 of the drawings.

Figure 8:
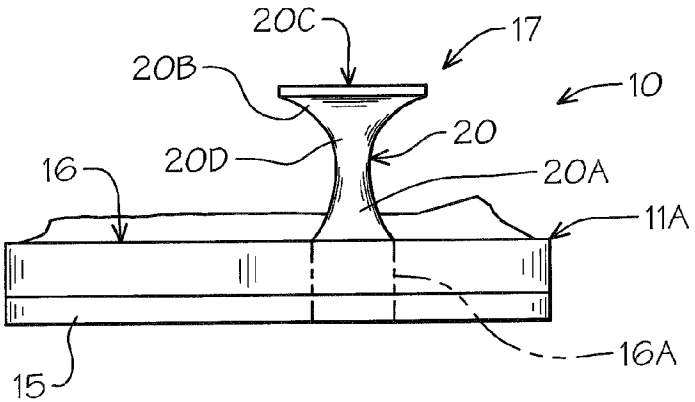
FIG. 8 is an end plan view on lines 8-8 of FIG. 7.

The resilient molded post body 20 has a contoured upstanding body portion 20A with an enlarged flared annular top portion 20B having a flat upper surface 20C thereon. The contoured body portion 20A has a central area of reduced transverse dimension at 20D defining a curvilinear shape when viewed in its assembled, inserted and locked mounting position in alignment with the longitudinal center axis of the assembled sole 11 illustrated best in FIG. 8 of the drawings.

In use, a variety of different decorative design ornamentations (not shown) can be attached to or formed within the annular top portion 20B upper surface 20C of the post body 20 which will allow for interchangeable design embellishments by replacing the so designed post assembly.

To selectively secure the post assembly 17 into the receiving mount 18, the orientation of the locking tabs 24A and 24B positioned therewithin having tapered upper surfaces 25 will engage with correspondingly form registering surfaces 27 on the lug 22 so that by aligning the post tabs 24A and 24B for first insertion into the key hole opening and then with post rotation ninety degrees enable the securing tabs for registration therewithin to securely lock the post assembly 17 within the receiver mount 18 and therefore to the fabricated sole 11 as hereinbefore described.

It will thus be seen that a new and novel interchangeable footwear assembly construction has been illustrated and described and it will be apparent to those skilled in the art that various changes and modifications may be made thereto without departing from the spirit of the invention.

Therefore I claim:

1. In combination, a sandal adapted for receiving a foot of a wearer, said sandal comprising a sole having a toe end portion and a heel end portion, and a single interchangeable flexible toe post registerable within said toe end portion, said toe post comprising, an elongated transversely annular curved resilient upstanding post body with a bifurcated cylinder body extending longitudinally therefrom, oppositely disposed aligned post lock tabs extending independently from said bifurcated cylinder body, an enlarged annular flat top end portion extending perpendicularly to said upstanding post body, a post receiver mount in an opening in said sole toe end portion, said post receiver mount comprising, an annular base of a dimension greater than that of said toe end opening, upstanding spaced oppositely disposed arcuate step lugs on said base registerable within said opening in said toe end portion, said spaced arcuate step lugs defining a key hole opening in said post receiver mount for registerably receiving said post lock tabs.

2. The combination for a sandal and an interchangeable toe post set forth in claim 1 wherein said sole comprises, contoured upper layer having a tapered increased dimensional thickness from said toe portion to said heel portion.

3. The combination for a sandal and interchangeable toe post set forth in claim 1 wherein said toe post elongated transversely annular curved portion resilient upstanding post body and said enlarged annular flat top end portion are integral.

4. The combination for a sandal and interchangeable toe post set forth in claim 1 wherein said interchangeable toe post is selectively registerable within said post receiving mount.

5. The combination for a sandal and interchangeable toe post set forth in claim 2 wherein sole's bottom layer and overlying contoured top layer are of dissimilar material to one another.

6. The combination for a sandal and interchangeable toe post set forth in claim 1 wherein said elongated transversely annularly curved resilient upstanding post body has an area of reduced annular dimension midway along its longitudinal length.

* * * * *